US006978703B2

(12) United States Patent
Whitehead et al.

(10) Patent No.: US 6,978,703 B2
(45) Date of Patent: Dec. 27, 2005

(54) CAM GEAR HOLDING AND TURNING WRENCH

(75) Inventors: Michael L. Whitehead, Clarinda, IA (US); Donald R. Simmons, Spartanburg, SC (US)

(73) Assignee: Lisle Corporation, Clarinda, IA (US)

( * ) Notice: Subject to any disclaimer, the term of this patent is extended or adjusted under 35 U.S.C. 154(b) by 65 days.

(21) Appl. No.: 10/818,616

(22) Filed: Apr. 6, 2004

(65) Prior Publication Data

US 2005/0217437 A1 Oct. 6, 2005

(51) Int. Cl.[7] ..... B25B 13/10; B25B 13/56; B25B 13/48

(52) U.S. Cl. ..... 81/176.3; 81/176.1; 81/176.15; 81/176.2; 81/180.1

(58) Field of Search ..... 81/176.1–176.3, 81/180.1, 484, 488, 126, 128, 129, 179, 13, 81/165, 352–354; 157/1.3, 1.45; 269/278

(56) References Cited

U.S. PATENT DOCUMENTS 1,579,992 A * 4/1926 Altman ..... 81/176.15
2,444,371 A * 6/1948 Riccio ..... 81/176.3

OTHER PUBLICATIONS

Long Tran Invention Disclosure Agreement for a "Tool to hold camshaft gears on engine".
Invention Disclosure Agreement dated Nov. 20, 1993 by Scott Logue for "Turning and positioning Subaru camshafts for timing belt replacement".
Invention Disclosure Agreement dated Feb. 3, 1994 by Richard A. Bourne for "Tool for holding cam gears".
Invention Disclosure Agreement dated Aug. 1, 1994 by Robert J. Frost for "Adjustable spanner wrench for cam sprockets".
Invention Disclosure Agreement dated Nov. 1, 1994 by Lee Bohning for "Spanner type for holding sprockets".
Invention Disclosure Agreement dated Dec. 18, 1995 by Akira Iijima for "Timing belt sprocket holder".
Invention Disclosure Agreement dated Feb. 6, 1996 by Akira Iijima for "Timing belt sprocket holder".
Invention Disclosure Agreement dated Feb. 25, 1996 by Donald R. Simmons for "Camshaft pulley holder".
Invention Disclosure Agreement dated Aug. 11, 1997 by Jim Schlabaugh for "Tool to hold cam sprockets on vehicles with timing belts".
Invention Disclosure Agreement dated May 15, 2000 by Paul K. Yamamoto for "Camshaft or crankshalt pulley holding tool and cooling system pressure release valve".
Invention Disclosure Agreement dated Jul. 20, 2002 by Joseph Jaworski for "Universal adjustable camshaft and crankshaft pulley wrench".
Invention Disclosure Agreement dated Oct. 21, 2002 by Ken Moran for "Gear and sprocket holder".
Baum "Camshaft & Injection Pump Gear Holding/Turning Tool", Baum #4394, Toolsource #90324, http://www.toolsource.com.
Schley Products "Camshaft Pulley Holding Tool", Schley #96800, Toolsource #58945, http://www.toolsource.com.

* cited by examiner

*Primary Examiner*—Joseph J. Hail, III
*Assistant Examiner*—Bryan Muller
(74) *Attorney, Agent, or Firm*—Banner & Witcoff, Ltd.

(57) ABSTRACT

The cam gear holding and turning wrench includes first and second arms which are slidably attached one to the other and which include angled extensions that have transverse rods projecting therefrom so that the spacing of the rods may be adjusted while maintaining the region between the extensions accessible.

8 Claims, 3 Drawing Sheets

CAM GEAR HOLDING AND TURNING WRENCH

BACKGROUND OF THE INVENTION

In a principal aspect, the present invention relates to a special purpose wrench which may be utilized to engage and hold a cam or spur gear of the type having radial access openings in a fixed position or alternatively to rotate the gear.

When repairing vehicle engines it may be necessary to engage and hold a cam in a fixed position or to rotate the cam to facilitate removal of the cam for replacement of the seals or for some other engine repair operation. Typically, such cams (often termed cam shaft pulleys or spur gears) may include peripheral teeth and a generally flat planar hub section with a center opening for attachment of the cam to a camshaft by means of a bolt or other fastening device. Further, such cam shaft pulleys will typically include a series of axial passages spaced radially from the center of the spur gear or camshaft. To effectively remove the camshaft pulley or spur gear from a camshaft, it is necessary to hold the gear in a fixed position while engaging and removing the center bolt that holds the cam on the shaft with a wrench, for example, an impact wrench or air driven wrench. However, access to the bolt which holds the camshaft pulley or spur gear in position may be precluded in the event that some type of tool is utilized to engage the teeth of the pulley or spur gear or otherwise hold the gear in position. Thus, there has developed a need to provide a tool which will effectively hold the camshaft pulley or spur gear in a fixed position while at the same time providing access to the center axial camshaft pulley bolt or spur gear bolt which retains the pulley or gear mounted to and attached to a shaft.

Heretofore, various types of tools have been proposed for such an operation. For example, Baum Tools provides a camshaft and an injection pump gear holding and turning tool, Product No. 4394 for such a purpose. The tool includes a straight bar and a pivoting bar attached thereto. Each bar has a projecting rod which fits into an opening defined in the hub of the cam gear.

Another tool useful for such functions is made by Schley Products, Product No. 95800. This product includes an elongate arm with bifurcated arms projecting therefrom and having attached thereto transverse rod members designed to engage the cam openings associated with the hub of a camshaft pulley spur gear.

Each of the aforesaid tools is useful for its intended purpose. However, its utility is limited by the fact that the tool has limited adjustment capabilities. In other words, the described tools may not be used for successful engagement and turning of cams having various diameters with the hub openings positioned in spaced relation with respect to one another. Thus, there has developed a need for a more universal tool which would accomplish the function of holding a spur gear or camshaft gear and also which can be used for turning such a spur gear or camshaft pulley or gear.

SUMMARY OF THE INVENTION

Briefly, the present invention comprises a cam gear holding and turning wrench which includes a first elongate arm having a first section which is a generally flat planar section and a second section extending therefrom generally at an obtuse angle. An elongate slot is provided in the first section. A second arm is slidably mounted to the first arm. The second arm includes a third section generally parallel to and overlying the first section of the first arm. The second arm further includes a fourth section generally parallel to and spaced from the second section of the first arm. The first and third sections are slidably mounted and adjustable with respect to one another. The second and fourth sections each include projecting rods which extend transversely from the ends thereof for engagement with the radial openings defined in a camshaft pulley, spur gear or the like. The rods may thus be adjustably spaced to accommodate the spacing of the openings associated with a cam shaft pulley or spur gear. Inasmuch as the space or region between the rods is unoccupied by any metal or any part of the tool, that space is accessible for positioning a wrench on the center mounting bolt associated with the spur gear or camshaft pulley while the rods associated with the tool are adjusted and engaged with the radial openings of the camshaft pulley or spur gear.

Thus, it is an object of the invention to provide an improved tool or wrench for holding a cam gear in a fixed position and for turning of that cam gear.

It is a further object of the invention to provide a wrench which is capable of adjustment of the spacing of the rods or members which are utilized to hold the cam gear in a fixed position or for turning of the cam gear.

A further object of the invention is to provide a cam gear holding and turning wrench which is made from generally flat bar stock and which includes a mechanism for adjusting the wrench to accommodate camshaft pulleys, spur gears and the like having various sizes and configurations.

Another object of the invention is to provide a cam gear holding and turning wrench which is designed to avoid interference of the wrench with the center axis of the gear or sprocket so that another wrench or tool may be utilized to remove the bolt or fastener which holds the spur gear or camshaft pulley in position within the engine of an engine compartment.

Another object of the invention is to provide an inexpensive, rugged, easily used and easily adjusted cam gear holding and turning wrench.

These and other objects, advantages and features of the invention will be set forth in the detailed description which follows.

BRIEF DESCRIPTION OF THE DRAWING

In the detailed description which follows reference will be made to the drawing comprised of the following figures.

DESCRIPTION OF THE PREFERRED EMBODIMENTS

Figure 1:
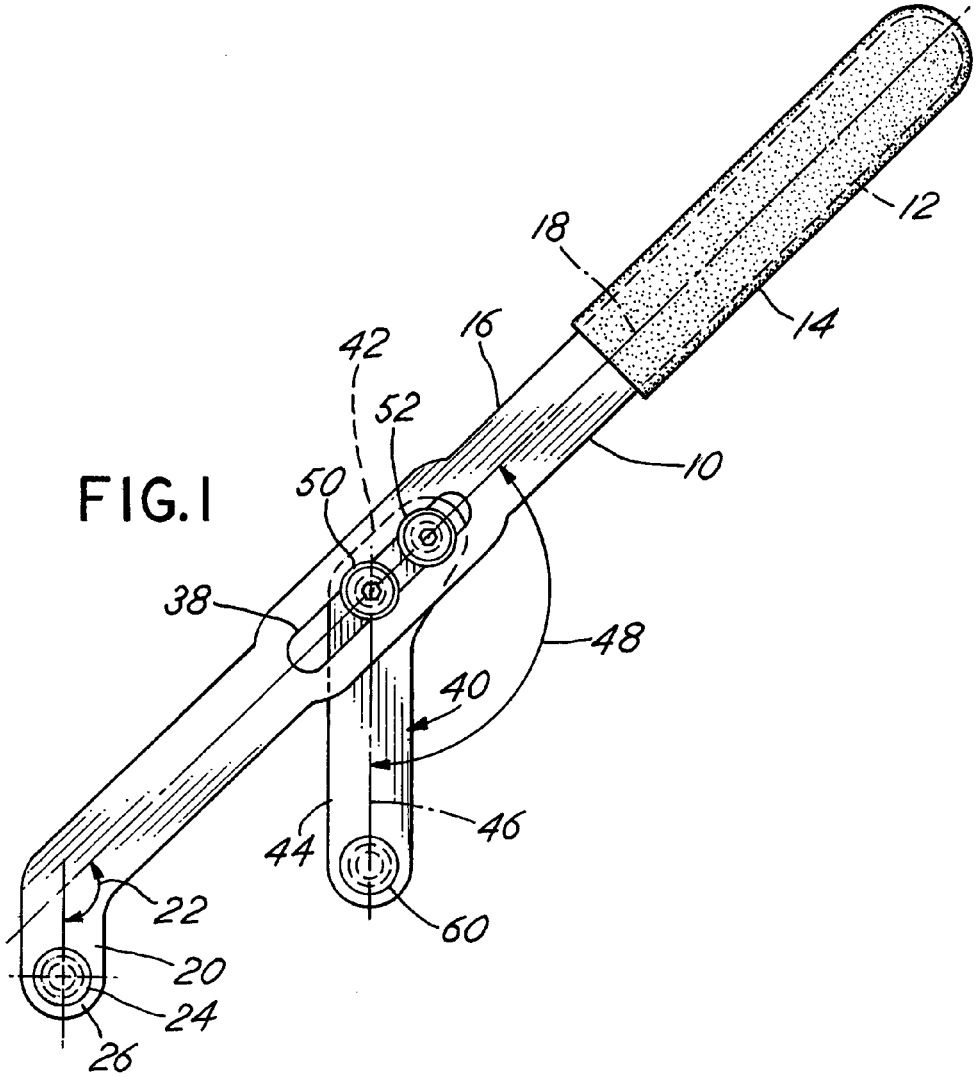
FIG. 1 is a plan view of the wrench of the invention.
Figure 2:
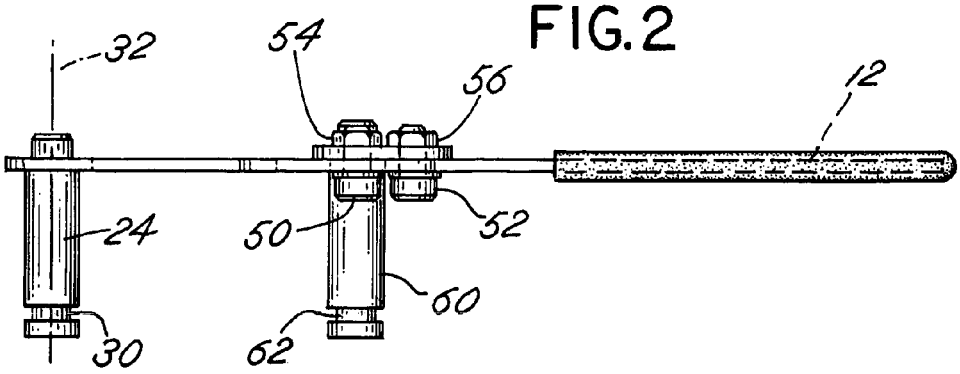
FIG. 2 is a side wrench of FIG. 1.
Figure 3:
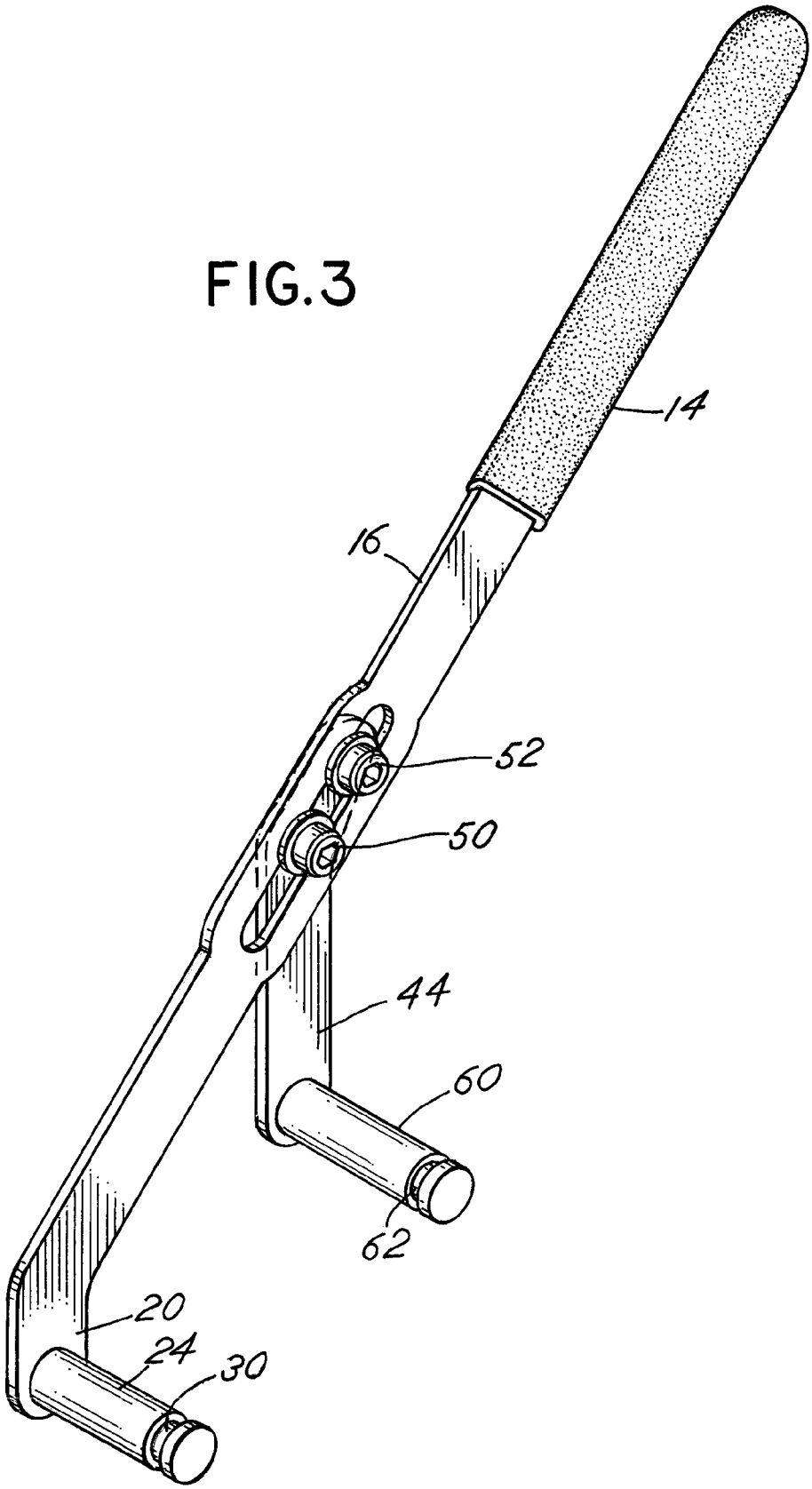
FIG. 3 is an isometric view of the tool of FIG. 1.
Figure 4:
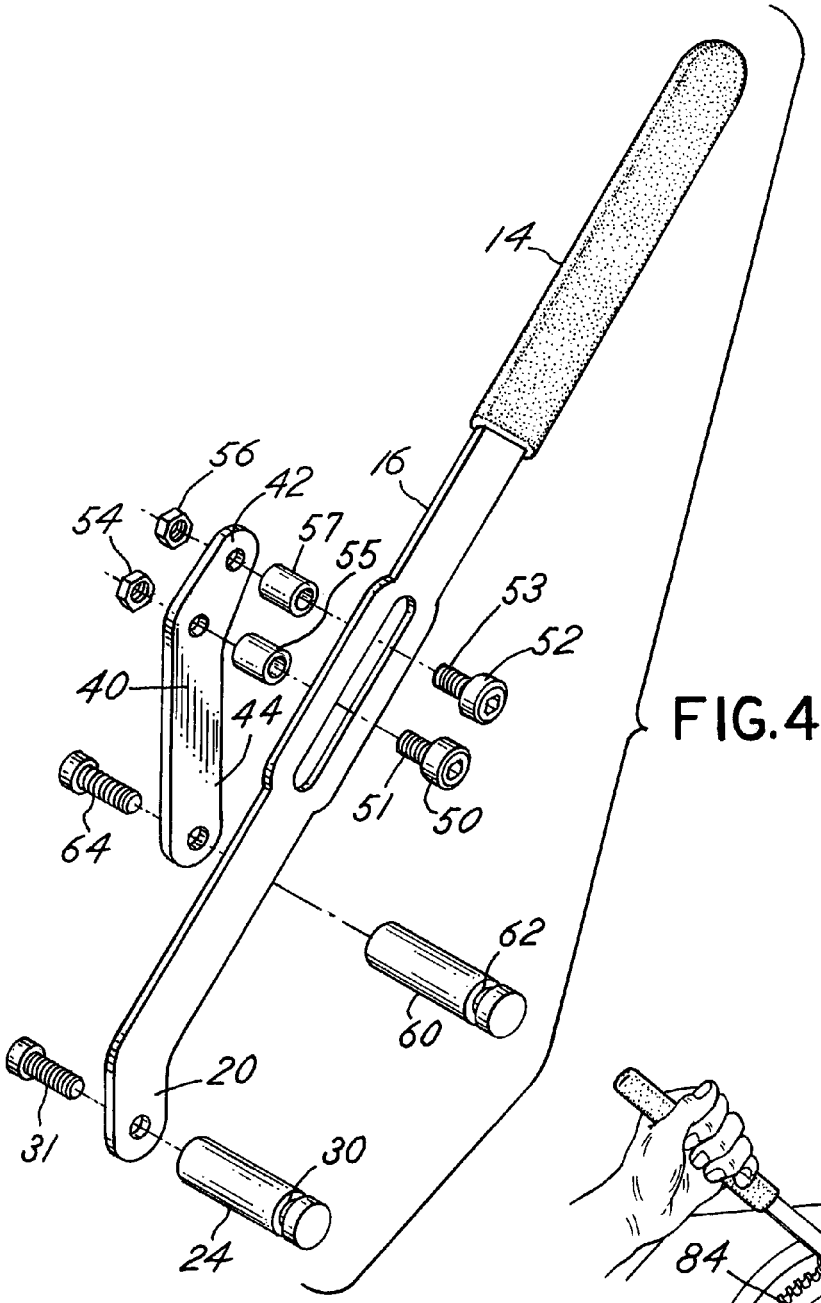
FIG. 4 is an exploded isometric view of the tool of FIG. 1.

Referring to the figures, the tool of the invention includes a first elongate arm 10 having a grip end 12 with a grip member 14, comprising a plastic or rubber grip member, attached thereto. The first arm 10 has an elongate center section or first section 16 extending along a longitudinal axis 18. The first arm 10 further includes a second section 20 which extends from the first section 16 at an obtuse angle 22. The second section 20 includes a first rod 24 extending transversely from the distal end 26 of the second section 20. The first rod 24 is a generally cylindrical rod having a circumferential groove 30. The first rod 24 is fastened by means of a bolt or fastener 31 to the second section 20 and extends along an axis 32 transversely to the plane of the first arm 10. The first arm 10 is formed from flat planar bar stock in the preferred embodiment, although other starting materials and stock may be utilized in the practice of the invention.

The first arm 10 further includes a through slot 38 within the first section 16 which extends axially in the direction of the axis 18. In the preferred embodiment, the slot 38 is approximately midway between the opposite ends of the first section 16 and extends in the range of 1–5 inches. The purpose or function of this slot 38 is to permit adjustment of the wrench to accommodate various sizes of cam gears, camshaft pulleys, sprockets and the like.

A second or sliding arm 40 includes a third section 42 which is generally parallel to and overlies the first section 16 of the first arm 10. The second arm 40 further includes a fourth section 44 having an axis 46 which forms an obtuse angle 48 generally equal to the obtuse angle 22 between the first section 16 and second section 20. Thus, the second section 20 and fourth section 44 are generally parallel to one another. The second arm 40 is likewise made from flat bar stock similar to the stock utilized to make the first arm 10.

First and second spaced bolts 50 and 52 in combination with nuts 54 and 56 are utilized to retain the first arm 40 attached to the second arm 10. The bolts 50 and 52 thus fit through the slot 38. The bolts are spaced approximately one inch from one another. The diameter of the bolts 50 and 52 is such that the main shaft 51, 53 respectively thereof is sized to slide or fit through tubular spacers 55, 57 within the slot 38. The nuts 54 and 56 may be tightened on the bolts 50 and 52 to hold the first arm 10 and second arm 40 together, but slidable in slot 38 and thereby space the second section 20 and fourth section 44 from one another.

The fourth section 44 includes a second rod 60 having substantially the same construction as the first first rod 24 thus including a groove 62 at its distal end and an attachment bolt 64 to hold the second rod 60 in place. The rods 24 and 60 extend an equal distance from the arms 10 and/or 40 so that the grooves 30 and 62 are substantially in the same plane. In practice, the rods 24 and 60 are in the range of 1–3 inches in length and extend at right angles or in a perpendicular direction from the bar stock forming the first arm 10 and the second arm 40. In practice, the obtuse angles 22 and 48 are in the range of 100–160° and are equal.

Figure 5:
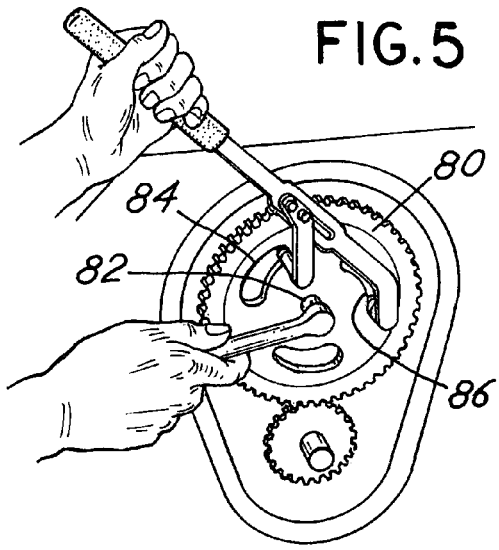
FIG. 5 is an isometric view of the tool of FIG. 1 depicted as it is used to engage a or cam gear.

The use of the tool is illustrated in FIG. 5. That is, the cam gear or spur gear or cam 80 typically includes a center bolt 82 for attachment to a shaft. The cam gear 80 further includes radially spaced openings 84 and 86. Thus, the rods 24 and 60 may be uniquely spaced to conform to the spacing of the openings 84 and 86 in the spur gear or cam gear 80. This is done by adjustment of the spacing of the second section 20 and fourth section 40 which is effected by the sliding of or fastening members or bolts 50 and 52 in slot 38. The spacing, thus, of the rods 24 and 60 can be made to accommodate the spacing of the openings 84 and 86.

Once the spacing is adjusted appropriately, the engagement of grooves 30, 62 will effectively maintain that spacing. The ends of the rods 24 and 60, and more particularly the slots or grooves 30 and 62, are thus fitted against the center hub or plate defined by the gear 80 and, more particularly, defined by the edges of the openings 84 and 86. The space or region between the rods 24 and 60, on a straight line, is open so that easy access is maintained to the cam fastening bolt 82 associated with fastening of the cam gear to its shaft. Bolt 82 may thus be engaged by a socket as the openings 84 and 86 are engaged by rods 24 and 60 to hold the cam gear 80 in a fixed position or to effect turning to the extent desired. The bolt 82 which holds the cam gear in position may be loosened while the cam gear 80 is held in such a position.

Thus, with the tool of the present invention, there is almost infinite adjustment available for use of the tool with variously sized cam gears, pulleys, or the like. The tool has generally universal application for multiple types of vehicle engine repairs.

The design of the tool may be varied without departing from the spirit and scope thereof. For example, the angles of the first and second sections and the angle of the third and fourth sections may be varied. The stock for the manufacture of the tool may be varied and include stock other than flat bar stock. The design and construction of the rods 24 and 60 and the number and position of grooves therein may be varied. The grooves need not be totally annular grooves. In other words, the grooves 30, 62 need not extend entirely about the periphery of the rod. The rods 24 and 60 need not necessarily be cylindrical rods. Other configurations may be utilized. Though there has been set forth a preferred embodiment of the invention it is to be understood that the invention is limited only by the following claims and equivalents thereof.

What is claimed is:

1. A cam gear holding and turning wrench comprising, in combination:

a first, elongate arm including a grip end, a cam engaging end, a generally straight first section extending from the grip end toward the opposite cam engaging end, a second section extending at an angle from the first section and terminating at the cam engaging end, a first rod extending transversely from the cam engaging end outwardly in a first direction;

a second sliding arm, said second arm including a third generally straight section slidably mounted to the first section of the first arm, said second arm further including a fourth section extending at an angle from the third section generally in the direction of the second section of the first arm, and further including a second rod attached to the fourth section and extending transversely therefrom generally parallel to the first rod; and an attachment means for adjusting the slidable position of the first arm on the second arm to thereby adjust the spacing of the rods, said fastening means being adjustable to permit adjustment of the spacing of the rods and maintain the space between said rods open.

2. The wrench of claim 1 wherein the first arm includes a slot in the straight section and the fastening means includes at least two spaced bolts extending from the second arm through the slot for holding the bolts in a slidable position in the slot.

3. The wrench of claim 1 or claim 2 wherein the first and second arms are flat members having first and third sections which overlay each other.

4. The wrench of claim 1 wherein the bolts include attachment nuts.

5. The wrench of claim 1 or claim 2 wherein the second and fourth sections are generally parallel and each form an obtuse angle with the first and third sections respectively.

6. The wrench of claim 1 wherein at least one of said rods includes an annular groove for engaging a cam gear opening.

7. The wrench of claim 1 wherein each of said rods includes an annular groove for engaging a cam gear opening.

8. The wrench of claim 1 or claim 6 or claim 7 wherein the rods extend transversely an equal distance from a plane defined by one of said arms.

* * * * *